United States Patent [19]

Hargrove et al.

[11] Patent Number: 4,959,963

[45] Date of Patent: Oct. 2, 1990

[54] APPARATUS AND METHOD FOR IMPROVING FILM ENTRAPMENT OF A MOISTURE PRE-SEPARATOR FOR A STEAM TURBINE

[75] Inventors: Homer G. Hargrove, Maitland; Harry F. Martin, Altamonte Springs, both of Fla.; Donald K. Whirlow, Murrysville, Pa.

[73] Assignee: Westinghouse Electric Corp., Pittsburgh, Pa.

[21] Appl. No.: 336,027

[22] Filed: Apr. 11, 1989

[51] Int. Cl.[5] ..... F01K 21/00

[52] U.S. Cl. ..... 60/646; 60/657; 60/685; 55/396; 55/397

[58] Field of Search ..... 60/646, 657, 685; 55/391, 396, 461, 473, 397

[56] References Cited

U.S. PATENT DOCUMENTS 4,527,396 7/1985 Silvestri, Jr. ..... 60/657 X 4,803,841 2/1989 Hargrove et al. ..... 60/657

4,811,566 3/1989 Silvestri, Jr. et al. ..... 60/657 X

*Primary Examiner*—Allen M. Ostrager

*Attorney, Agent, or Firm*—K. Bach

[57] ABSTRACT

A moisture pre-separator for a steam turbine includes an inner cylinder, an outer cylinder and a bottom interconnecting lower ends of the inner and outer cylinders. An annular collection chamber formed by the outer surface of the inner cylinder and the inner surface of the outer cylinder and the bottom is vented to communicate steam from the collection chamber to the interior of the inner cylinder, thereby equalizing pressure around the circumference of the entry gap and increasing effectiveness of moisture entrapment. Vanes are provided either on the outer surface of the inner cylinder or the inner surface of the outer cylinder, or both, in order to enhance swirling flow of moisture within the chamber, thereby helping to keep moisture away from the outer surface of the inner cylinder.

16 Claims, 4 Drawing Sheets

FIG. 6
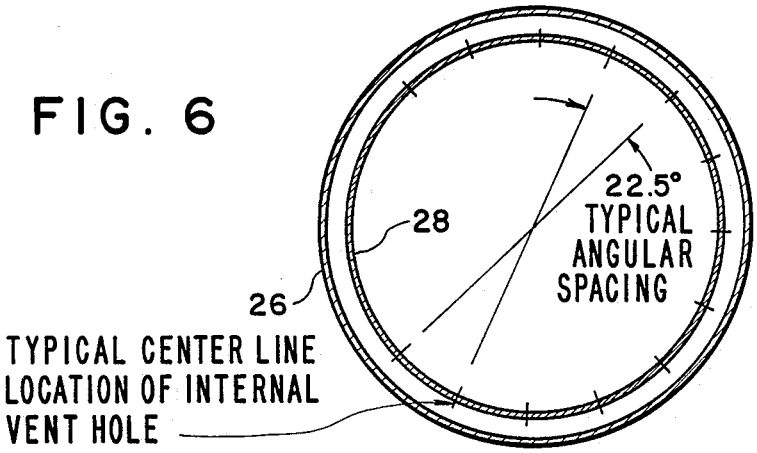
FIG. 7
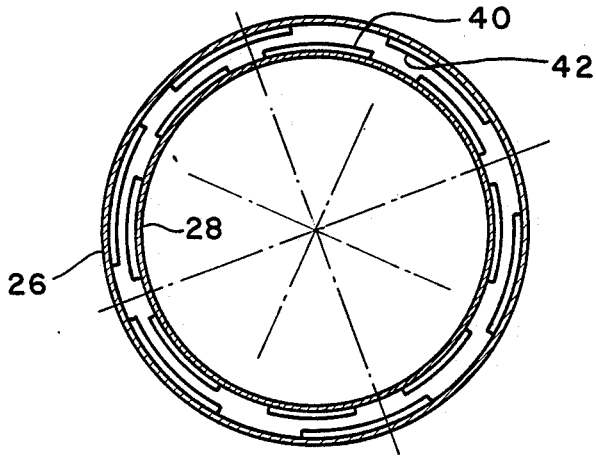
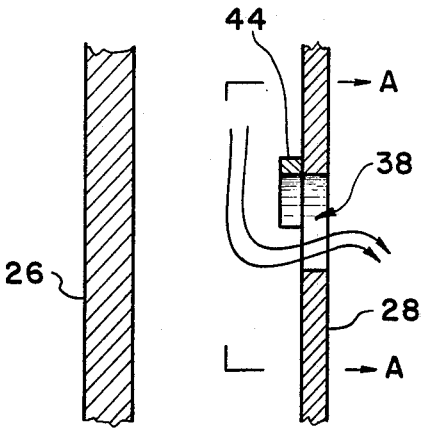
FIG. 8
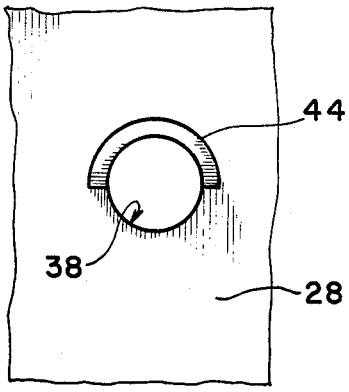
FIG. 9

APPARATUS AND METHOD FOR IMPROVING FILM ENTRAPMENT OF A MOISTURE PRE-SEPARATOR FOR A STEAM TURBINE

BACKGROUND OF THE INVENTION

1. Field of the Invention:

The present invention relates generally to film entrapment moisture pre-separators for control or elimination of nuclear high pressure turbine exhaust piping wall deterioration which is associated with the erosion-corrosion phenomenon.

2. Description of the Related Art:

The wet steam conditions associated with a nuclear steam turbine cycle have been observed to cause significant erosion/corrosion of cycle steam piping and components between the high pressure turbine exhaust and the moisture separator reheater. The pattern, location and extent of cross-under piping erosion/corrosion is a function of piping size, material and layout configuration, turbine exhaust conditions and plant load cycle. However, as a general rule, a base-loaded plant having carbon steel cross-under piping with typical nuclear high pressure turbine exhaust conditions of 12% moisture and 200 psia will experience, within 3 to 5 years after initial start up, erosion/corrosion damage levels that require weld repair to restore minimum wall thickness. Such weld repairs are expensive, time consuming and often result in extended planned outages and occasional unscheduled outages.

Weld repair of erosion/corrosion in cross-under piping is expensive, but the alternative of partial or complete replacement of the eroded piping is even more expensive, given the time requirements and logistics involved in pipe replacement.

The bulk of piping wall erosion in nuclear plants has been found to be the result of a form of metal attack referred to as "flow assisted corrosion" (FAC). FAC-type erosion can occur anywhere in a piping system where a high purity water film attaches to and moves over a surface. Under the temperature range normally associated with nuclear power plant high pressure turbine exhaust piping (250° F to 350° F) these high purity water films have the ability to dissolve the normally protective magnetite layer in such a manner that continuous oxidation of the steel below the magnetite layer will occur. FAC-type corrosion manifests itself in piping systems as scalloped-out or fluted regions, which are indicative of mass transfer occurrence as a result of the magnetite dissolution. The necessary water film associated with FAC-type erosion/corrosion is, in the case of high pressure nuclear turbine exhaust piping, created by the high pressure turbine. By virtue of its geometry, a nuclear high pressure steam turbine exhaust casing creates vortices in the exiting wet steam. Such vortices have long been observed in curved piping where they are known as secondary flow patterns. The two phase flow in a curved conduit is described in U.S. Pat. No. 4,803,845 and is illustrated in FIGS. 1 and 2. Basically, nuclear turbine exhaust casings create vortices and generate a centrifugal force field causing it to function as a centrifugal separator by forcing the heavier or larger water droplets to migrate or drift through the gas phase (steam) and be deposited on the exhaust casing wall. The extent of separation depends on the steam flow or velocity, exhaust casing geometry (primarily the radius of curvature), and steam condition such as pressure, temperature and quality. By considering the resulting centrifugal force and the resisting drag force under typical exhausting conditions, the relative velocity of moisture droplets 50 μm or bigger with respect to the steam will result in trajectories such that 20 to 30% of the total moisture present at the exit of the high pressure turbine could appear as a water film on the exhaust casing walls. This high purity water film is apparently responsible for the FAC observed in the downstream exhaust and extraction piping. It has been, therefore, a long standing problem to remove this film before it can pass into the outlet nozzle in order to reduce or eliminate cross-under piping FAC.

Since moisture separators are already present as an interstage element between the high pressure turbine steam exhaust and the low pressure turbine inlet, the devices to remove moisture in the steam before it enters the existing separators are known as moisture pre-separator or simply "pre-separators". Specifically, pre-separators that interrupt the water film prior to its entrance into the exhaust piping proper are referred to as "in-turbine film entrapment" type pre-separators.

One type of in-turbine film entrapment pre-separator is illustrated in FIG. 3. The pre-separator "skims" the water film off the turbine exhaust casing walls in the exhaust nozzle- exhaust casing interface region and collects the water in a small annular chamber between the skimmer body and the exhaust nozzle. This chamber acts as a moisture collection cavity, but provides little hold-up volume and thus requires the drilling of some (typically four) large drain lines (larger relative to the collection chamber volume) through the turbine nozzle-casing walls.

The in-line pre-separator illustrated in FIG. 4 is described in detail in U.S. Pat. No. 4,803,841. The pre-separator described therein provides a structure having a condensate collection zone located outside the turbine proper as a jacketed cross-under pipe. The dimensions and configuration of the collection chamber are varied as desired and multiple drain lines are located around the periphery of the collection chamber, not necessarily in uniform spacing, to best suit backfit situations and thus minimizing the need to relocate existing piping and avoiding expensive modification or interferences with existing structures. Basically, the pre-separator includes a pre-separator body formed around an existing cross-under piping to form an annular moisture collection chamber. Flow director plates are used to channel the water film flow (as indicated by directional arrows) into the annular collection chamber. This pre-separator is described in greater detail in the aforementioned U.S. patent. The upper extension cylinder geometry is normally tailored to provide a controlled entry gap between the exhaust casing inner diameter walls and the leading edge of the upper extension cylinder. The upper extension cylinder thus provides the skimmer function of the in-line film entrapment type pre-separator.

The prime requisite for a properly functioning entrapment pre-separator regardless of specific application is the controlled (narrow) opening or gap provided by the upper extension cylinder leading edge and the high pressure turbine exhaust casing in the intersection region between the turbine exhaust casing volute and exhaust nozzle opening. It is this design requirement that is the most difficult to achieve and has been a cause for reduction in water film capture efficiency. For example, in the configuration illustrated in FIG. 4, it has been estimated based on prior experience that between 20 and 35% of the total moisture in a particular high pressure turbine exhaust would be on or very near the exhaust casing volute walls and could be trapped by the skimmer. Once placed in service, however, pre-separator performance has indicated a lower percent of the total moisture being collected than expected. It was discovered that one source of the problem was the exhaust steam velocity around the periphery of the h.p. turbine exit nozzles and the pre-separator upper extension cylinder (where the water film of entrance is located) was very non-uniform. This discovery was made in a carefully instrumented test series using a one sixth scale model air-water facility. These scale model tests were carefully designed to replicate high pressure turbine exhaust chamber velocities, phase separation characteristics between liquid and gas (film production on the exhaust casing walls) and hydraulics in the pre-separator and turbine exhaust. As is known in the field of hydraulics, this non-uniform approach velocity will set up a non-uniform pressure field or pressure gradient around the entry gap. Such pressure gradients then either locally block entry of the water film into the annular gap and/or cause the water film captured to be swept out of the annulus back into the main flow, thus bypassing the pre-separator collection chamber. Although reducing the pre-separator entry gap offers some minor improvement in water film capture by increasing the pressure drop through the entry gap, such an approach is impractical in practice and is not sufficiently effective to offset totally the large pressure gradient observed in the scale model flow test.

One method to overcome this loss of water film capture resulting from a pressure gradient or pressure recovery occurring around the entry gap is to provide a motive fluid using the carrier gas or vapor to entrain the captured fluid film. Such concepts have been used in moisture extraction zones of steam turbines and has formed the basis for one type of pre-separator discussed in U.S. Pat. No. 4,624,111. This motive fluid approach in reality provides a venting mechanism for relieving the pressure build up that would occur if the velocity of the carrier gas entraining the moisture, or in this situation, dragging a water film along the turbine exhaust casing walls, is brought to a near stagnation (zero velocity) condition. In past practice, however, the standard venting scheme has involved large external piping systems. In turn, the large amount of motive fluid (steam) necessary must be separated from the entrained water film, for reasons for economy, and the motive fluid returned into the system. This requires expensive and complicating features, especially so when applied to installing a pre-separator into an existing nuclear steam turbine system.

SUMMARY OF THE INVENTION

An object of the present invention is to provide an apparatus and method which uses a motive fluid for enhancing fluid film capture in a film entrapment pre-separator without the need for large expensive external piping and phase separation equipment to process motive steam as required in all previous art.

Another object of the present invention is to provide a pre-separator for a steam turbine which vents an annular collection chamber internally, without requiring external piping or motive fluid.

Another object of the present invention is to provide a pre-separator for a steam turbine which is relatively simple in construction and cost-effective to produce.

Another object of the present invention is to equalize pressure around an entry gap of a pre-separator so as to increase film entrapment effectiveness.

In a preferred embodiment of the present invention, a moisture pre-separator for a steam turbine having an exhaust portion of an exhaust nozzle includes an inner cylinder having inner and outer surfaces, an outer cylinder having inner and outer surfaces and being concentric with the inner cylinder, a bottom interconnecting lower ends of the inner and outer cylinders, an annular collection chamber formed by the outer surface of the inner cylinder, the inner surface of the outer cylinder, and the bottom, drains disposed in the outer cylinder near the bottom for draining moisture collected in the annular collection chamber, an upper cylinder extension connected to and extending the inner cylinder into the exhaust nozzle of the exhaust portion of the steam turbine, an entry gap being formed between the upper cylinder extension and the exhaust nozzle, the inner and outer cylinders and bottom forming a pre-separator body which is connectable at one end to cross-under piping and to the nozzle at the other end so as to communicate steam through an interior of the inner cylinder, and vent means for communicating steam from the collection chamber to the interior of the inner cylinder, thereby equalizing pressure around the circumference of the entry gap and increasing effectiveness of moisture entrapment.

The foregoing and other features and advantages of the pre-separator in accordance with the present invention will become more apparent from the following detailed description, taken in conjunction with the drawings.

BRIEF DESCRIPTION OF THE DRAWINGS

FIG. 6 is a schematic, cross-sectional view of the pre-separator of FIG. 5, illustrating center lines of vent holes;

FIG. 7 is a cross-sectional view of the pre-separator of FIG. 5, illustrating vanes disposed on opposite side walls of the collection chamber;

FIG. 8 is an enlarged, sectional view of the pre-separator of FIG. 5; and

FIG. 9 is a side elevational view of a portion of the inner cylinder, illustrating a vent hole and weir.

DETAILED DESCRIPTION OF THE PREFERRED EMBODIMENTS

Figure 4:
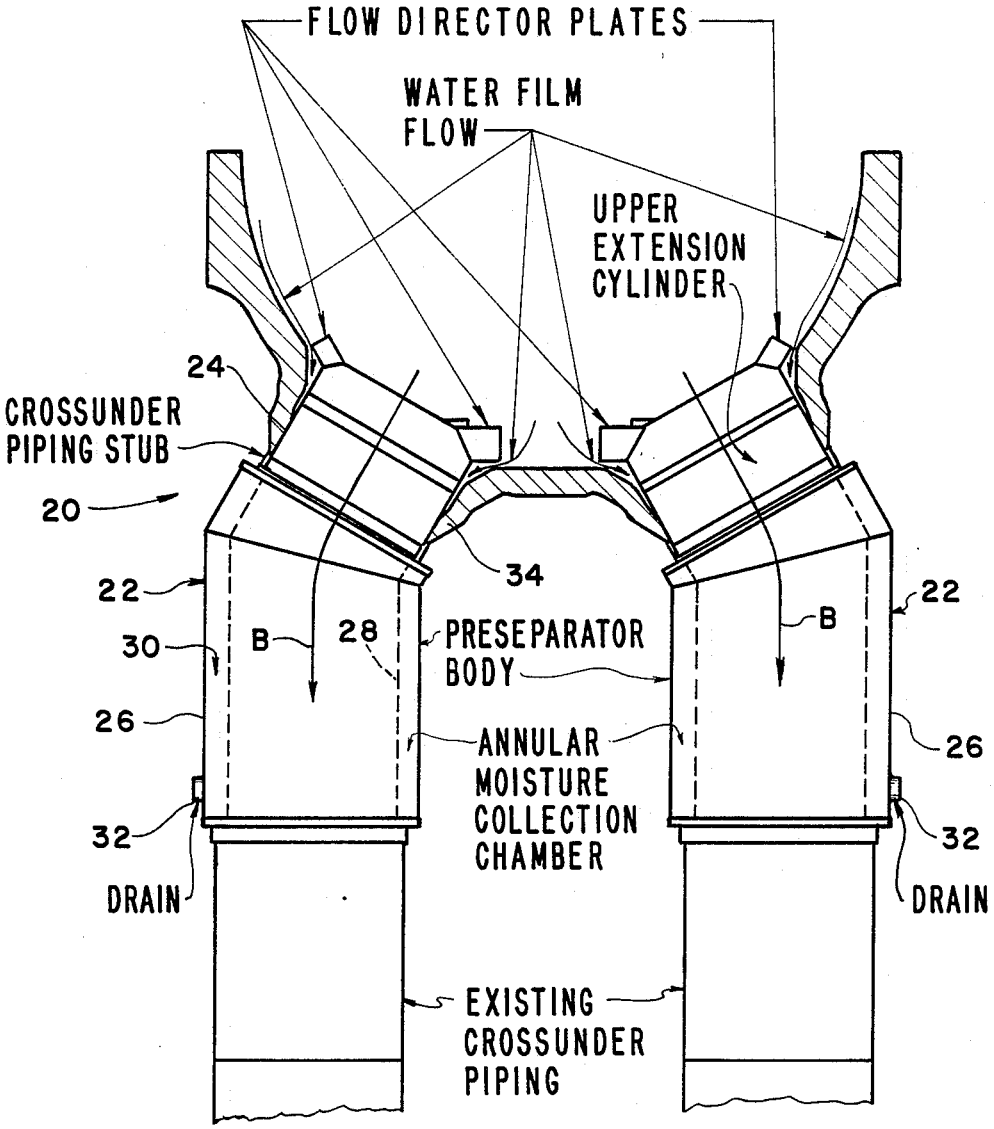
FIG. 4 is a side elevational view, partly in section, showing known pre-separators.

Referring to FIG. 4, an in-line pre-separator used in an exhaust portion 21 of a steam turbine is generally referred to by the numeral 20 and includes a pre-separator body 22 and an upper extension cylinder 24. The pre-separator body 22 is formed by two concentric cylinders, the outer cylinder 26 being joined to the high pressure turbine exhaust nozzle 34 to form a pressure boundary. The inner cylinder 28 replaces a removed section of cross-under pipe 29. The inner and outer cylinders 26 and 28 are joined at their lower ends to a bottom 31 to form an annular collection chamber 30 which receives the moisture separated from the steam. Drains 32, not necessarily uniformly spaced around the pre-separator body outer circumference, provides means to drain collected moisture from the annular collection chamber 30.

The upper extension cylinder 24, having an outer diameter very closely matching that of the inner diameter of the pre-separator body inner cylinder 28, is slidably positioned within and then joined to the pre-separator body inner cylinder 28, such that the leading edge of the upper end of the upper extension cylinder 24 forms a narrow gap 25 between the inside surface of the turbine exhaust casing-nozzle 34 and the upper extension cylinder 24 outer surface. This gap or opening, although variable in size around the periphery of the turbine exhaust casing-exhaust nozzle region, forms a generally narrow annular conduit for passage of the water film skimmed from the turbine wall down into the annular collection chamber of the pre-separator body.

Although this annular conduit is sufficiently large to easily pass the thin water film flowing around the turbine exhaust casing, the high velocity carrier steam also enters the gap and is brought to near stagnation conditions in the constricted flow path. Because both the annular gap flow cross-section and the entering steam velocities are non-uniform around the periphery of the annular gap, the conversion of steam momentum into pressure varies around the periphery of the annular opening. This results in a pressure gradient around the annular gap periphery that locally prevents the majority of the water from entering the gap and/or redirects the film from continuing its swirling flow down into the annular gap towards the pre-separator body by forcing it to follow paths generally parallel to the annular opening towards zones of lower pressure where the flow direction and acceleration cause it to be forced out of the gap and returned to the main body of the steam flow. The overall action of this peripheral pressure gradient around the annular gap is to create short circuit paths in which the water film is first forced around rather than down the pre-separator upper extension cylinder 24 and then back into the cross-under line, thus reducing pre-separator moisture removal effectiveness.

By virtue of the hydraulic principles discussed above, the annular collection chamber 30 in the pre-separator body 22 is positively pressurized with respect to the main steam flowing in the circular cross-section of the inner cylinder 28. This positive pressure is a direct consequence of the pressure build up in the entry gap 25 around the upper extension cylinder 24.

It is known to provide venting or pressure relief by connecting the pre-separator annular moisture collection volume to a lower pressure source in order to counteract or eliminate this undesirable pressure gradient. For example, one method involves venting the collection volume to a lower pressure external to the entire pre-separator proper (meaning that the lower pressure is outside the entire exhaust system piping).

The present invention provides another method to relieve this pressurization of the annular collection chamber by providing the necessary relief venting using properly arranged and sized vent holes through the pre-separator body inner cylinder wall, thereby directly connecting the pre-separator body annular moisture collection chamber 30 with the turbine exhaust steam flow indicated by directional arrow "B" in FIG. 4. This venting arrangement allows the carrier gas (steam) entering the pre-separator with the moisture film to flow down into the pre-separator annular collection chamber in order to substantially reduce the pressure gradient around the upper extension cylinder-turbine casing entry gap 25. This permits the moisture film on the turbine casing wall to flow past the entry gap 25 and on into the pre-separator annular collection chamber 30. This results in an internal venting of the motive fluid (steam).

Figure 5:
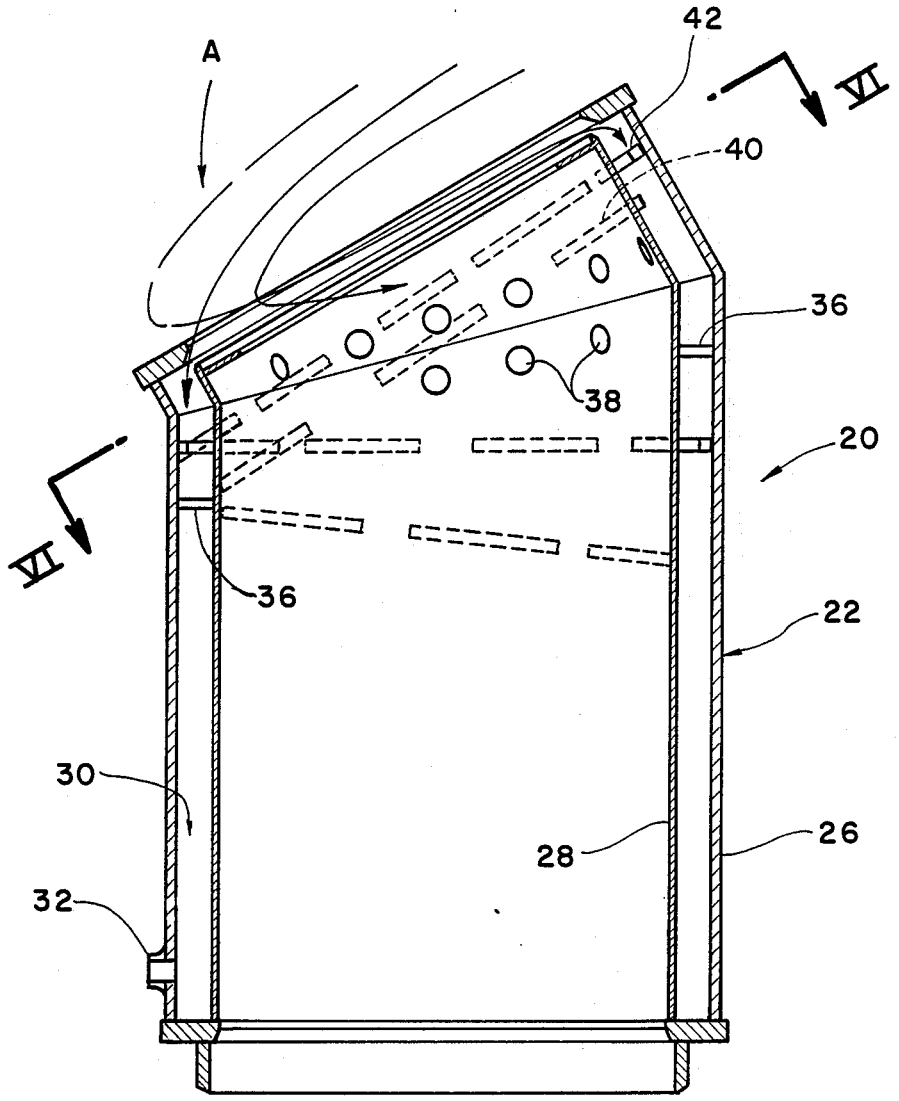
FIG. 5 is a sectional view of a pre-separator according to one embodiment of the present invention.

FIGS. 5 and 6 illustrate a first, preferred embodiment of the invention. The pre-separator 20 has a pre-separator body 22 which is formed by an outer cylinder 26 having inner and outer surfaces and an inner cylinder 28 having inner and outer surfaces. An annular collection chamber 30 is formed between the two cylinders 26, 28 and a bottom 31 and is provided with drains 32 in a lower portion thereof of the outer cylinder 26 near the bottom. The pre-separator 20 has the same basic structure as that which is illustrated in FIG. 4, including the use of spacing pins 36 to hold the two cylinders in a spaced relationship to each other.

The present invention lies in the provision of a plurality of internal vent holes which are formed in the inner cylinder 28 near the upper end thereof. The vent holes, which are especially sized and placed, directly connect the separator body annular moisture collection chamber 30 with the turbine exhaust steam flow. Thus, this venting arrangement allows the carrier gas entering the pre-separator with the moisture film to flow down into the pre-separator annular collection chamber 30 thereby substantially reducing the pressure gradient around the upper extension cylinder-turbine casing entry gap (which leads to the top of the collection chamber) and permitting the moisture film on the turbine casing wall to flow past the entry gap and on into the pre-separator annular collection chamber.

Figure 1:
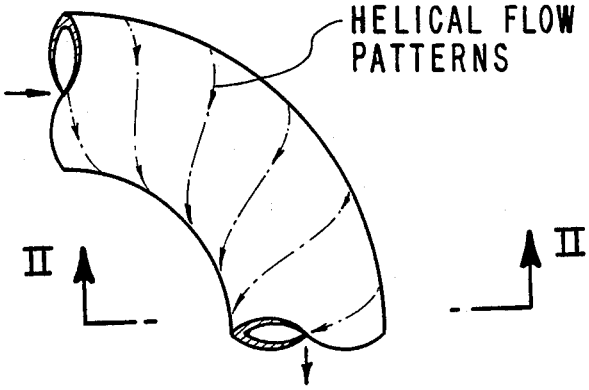
FIG. 1 is a side elevational view, partly in section, showing helical flow patterns through a bend portion of a pipe.
Figure 2:
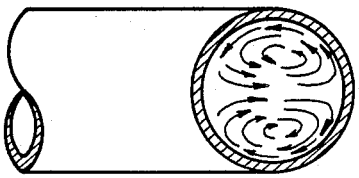
FIG. 2 is a sectional view taken along line II—II of FIG. 1.
Figure 3:
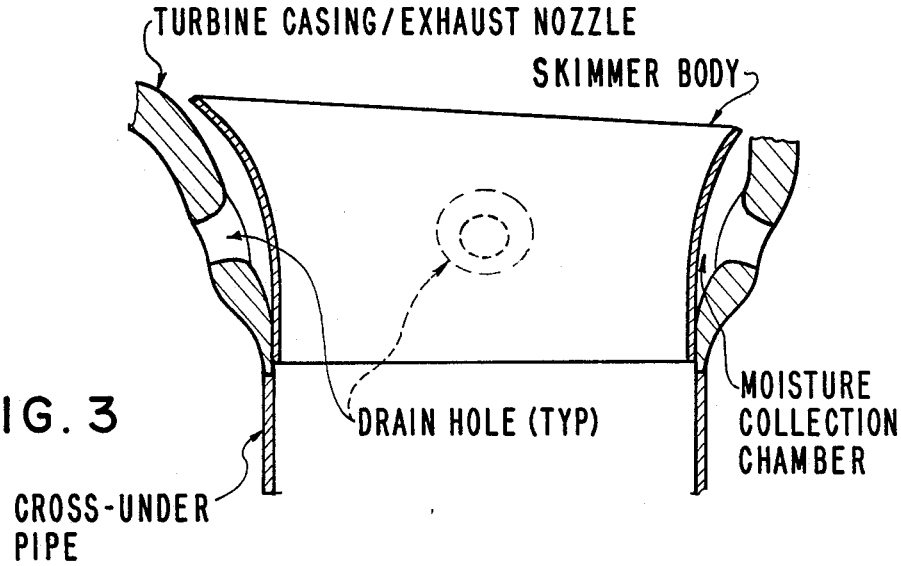
FIG. 3 is a sectional view illustrating a known pre-separator having a skimmer body disposed in an exhaust nozzle portion of a turbine casing.

Other hole sizes and shapes may be employed that could still utilize the concept of internal venting of a motive fluid, where the motive fluid by conversion of kinetic energy into pressure energy generates sufficient pressure head to directly return the motive fluid into the source steam rather than being piped to lower pressure regions external to the pre-separator and cross-under piping. The carrier gas, i.e., steam, is illustrated in FIG. 5 by swirling directional arrows A which enter the chamber at the upper end thereof and exit through the vent holes 38 As a result of the vent holes 38, the trapped moisture film will remain essentially on the outside wall of the annular collection chamber, retaining to a large degree, the swirling pattern exhibited in the turbine exhaust casing as the film approaches the pre-separator entry gap (as per FIG. 1).

In order to assure that the annular pre-separator collection chamber 30 is positively pressurized with respect to the cross-under steam flowing in the pre-separator body inner cylinder 28, vent hole sizing is such that the individual vent openings are collectively not larger in cross-sectional area than the plane area defined by the distance between the inner cylinder outside diameter and the outer cylinder inside diameter of the pre-separator body multiplied by the vent hole diameter.

Generally, hole placement is near the upper end of the inner cylinder as illustrated in FIG. 5. Although some water droplets will likely pass through the holes, they will be broken up into smaller droplets, which can be carried within the exhaust steam flow, thereby eliminated this moistures contribution to FAC. The further down the inner cylinder the holes are place, the more droplets will likely be carried within the exhaust steam flow. Thus, in keeping with the goal of moisture entrapment, the holes should preferably be kept in the upper part of the cylinder.

To further enhance film retention on the outside wall of the annular collection chamber 30 a plurality of vanes 40 can be provided radially on the outside surface of the inner cylinder. Additional vanes 42 may be provided on the inside surface of the outer cylinder 26. In one embodiment, vanes 40 and 42 are used simultaneously. The vanes 40 and 42 act as channels or fin-like members to project radially inwardly into the collection chamber 30, and are typically perpendicular to their respective mounting surfaces. The vanes aid in maintaining, creating, and reinforcing the swirl pattern of the two phase flow as the flow proceeds down into the pre-separator annular chamber 30. The vanes are generally arranged in a helical screw thread pattern and act as swirl pattern enhancing means. While the vanes are illustrated in FIG. 5 as discontinued segments, they may also be formed as continuous members, resembling a screw thread. Vane sizing, shape, spacing (pitch between adjacent vanes) and location may be varied to meet specific design or performance requirements. Moreover, patterns other than screw thread patterns may be used, such as herringbone patterns, so long as they are capable of enhancing or creating the swirling pattern. The swirling pattern provides additional centrifugal force which reduces the amount of moisture particles attaching to the inside surface of the pre-separator annular collection chamber where the internal vent holes are located.

FIG. 6 is a cross-sectional view taken along line VI—VI of FIG. 5. FIG. 6 shows typical center line locations B of the top row of internal vent holes provided in the inner cylinder 28 (while the center lines are shown, the holes themselves have been omitted). A second, lower row has fewer holes, with both rows being respectively disposed on opposite sides of a line which divides the pre-separator body into two cylindrical portions, one angled with respect to the other. The center lines B illustrate typical angular spacing of the holes which, in FIG. 7 are placed at 22½° intervals.

FIG. 7 shows the segmented vanes 40 and 42 provided on the outer surface of inner cylinder 28 and the inner surface of outer cylinder 26, respectively. The vane should extend downwardly from the top of the pre-separator, but need not extend beyond the vent holes.

Referring to FIGS. 8 and 9, the vent holes 38 are preferably provided with deflectors 44 which are substantially semicircular in shape. The deflectors 44 partially surround each vent hole opening for the purpose of reducing re-entrapment of moisture into the vent holes. When a semicircular deflector is used, the deflector covers the upper portion of the hole since induced fluid movement is downward. The deflectors 44 may be either hole or partial circular bosses attached to the inner diameter of the angular chamber around the holes or may be inserted pipes threaded or welded into the vent holes.

The internal venting of the pre-separator annular collection chamber 30 provides effective means to achieve a motive fluid, i.e., steam, to enhance capture of the water film on the walls of a nuclear turbine exhaust casing nozzle. Thus, the venting substantially reduces, if not eliminates, pressure distributions around the entry gap into the pre-separator skimmer, thereby promoting capture of the water film on the turbine casing walls. The vent holes provide direct communication of the motive steam between the annular collection chamber with the cross-under pipe and thereby avoid expensive outside piping. The vented flow is returned internally directly into the stream from which it was originally moved.

The vanes on either or both of the interior walls of the pre-separator annular collection chamber enhance moisture film retention on the walls of the collection chamber and reduce re-entrapment of the moisture through the vent holes.

The structures described increase the moisture removal efficiency of film entrapment pre-separators by venting an annular moisture chamber to allow communication between the interior of cross-under piping with the interior of the collection chamber. As a result, large pressure and velocity variations in the wet steam flow in and around the entry gap (between the turbine exhaust casing wall and the pre-separator skimmer) are significantly reduced. The removal effectiveness is further enhanced by providing swirl-flow-inducing vanes within the collection chamber. A further aspect of the methodology is to provide weirs at the vent holes to prevent re-entrapment of captured moisture.

It will be recognized by those of skill in the art that numerous modifications and adaptations may be made to the various structures and methodology disclosed herein. Thus, it intended by the appended claims to encompass all such modifications which fall within the true spirit and scope of the invention.

What is claimed is:

1. A moisture pre-separator for a steam turbine having an exhaust portion and an exhaust nozzle, the pre-separator comprising:

an inner cylinder having inner and outer surfaces;

an outer cylinder having inner and outer surfaces and being concentric with the inner cylinder;

a bottom interconnecting lower ends of the inner and outer cylinders;

an annular collection chamber formed by the outer surface of the inner cylinder, the inner surface of the outer cylinder, and the bottom;

a drain disposed in the outer cylinder near the bottom for draining moisture collected in the annular collection chamber;

an upper cylinder extension connected to and extending the inner cylinder into the exhaust nozzle of the exhaust portion of the steam turbine, an entry gap being formed between the upper cylinder extension and the exhaust nozzle;

said inner and outer cylinders and bottom forming a pre-separator body which is connectable at one end to cross-under piping and to the nozzle at the other end so as to communicate steam through an interior of the inner cylinder; and vent means for communicating steam from the collection chamber to the interior of the inner cylinder, thereby equalizing pressure around the circumference of the entry gap and increasing effectiveness of moisture entrapment.

2. A moisture pre-separator as recited in claim 1, wherein the vent means comprises a plurality of vent holes formed in the inner cylinder.

3. A moisture pre-separator as recited in claim 1 further comprising vane means, disposed in at least an upper end portion of the pre-separator body, for directing steam flow into the collection chamber in a swirling direction.

4. A moisture pre-separator as recited in claim 3, wherein the vane means comprises a helical protrusion formed on the outer surface of the inner cylinder on at least an upper portion of the inner cylinder.

5. A moisture pre-separator as recited in claim 3, wherein the vane means comprises a helical protrusion formed on the inner surface of the outer cylinder on at least an upper portion of the outer cylinder.

6. A moisture pre-separator as recited in claim 3, wherein the vane means comprises a first helical protrusion formed on an inner surface of the outer cylinder on at least an upper portion of the outer cylinder, and a second helical protrusion formed on the outer surface of the inner cylinder on at least an upper portion of the inner cylinder.

7. A moisture pre-separator as recited in claim 2, wherein the vent holes are formed near the exhaust nozzle end of the inner cylinder.

8. A moisture pre-separator as recited in claim 2, further comprising a deflector formed at least partially around each vent hole.

9. A moisture pre-separator as recited in claim 8, wherein each deflector is an arcuate wall formed around at least an upper periphery of each hole.

10. A method for increasing film entrapment effectiveness of a pre-separator having an inner cylinder, an outer cylinder, a bottom and an annular collection chamber formed by the inner and outer cylinders and the bottom, the method comprising:

forming vent holes in the inner cylinder to equalize pressure around a circumference of an entry gap between an upper cylinder extension which is connected to the inner cylinder and an exhaust nozzle of an exhaust portion of a steam turbine, said entry gap providing an entrance to said collection chamber.

11. A method as recited in claim 10 further comprising directing steam flow in the collection chamber with vane means to create a swirling flow within the collection chamber.

12. A moisture pre-separator for a steam turbine having an exhaust portion and an exhaust nozzle, the pre-separator comprising:

an inner cylinder having inner and outer surfaces;

an outer cylinder having inner and outer surfaces and being concentric with the inner cylinder;

a bottom interconnecting lower ends of the inner and outer cylinders;

an annular collection chamber formed by the outer surface of the inner cylinder, the inner surface of the outer cylinder, and the bottom;

a drain disposed in the outer cylinder near the bottom for draining moisture collected in the annular collection chamber;

an upper cylinder extension connected to and extending the inner cylinder into the exhaust nozzle of the exhaust portion of the steam turbine, an entry gap being formed between the upper cylinder extension and the exhaust nozzle;

said inner and outer cylinders and bottom forming a pre-separator body which is connectable at one end to cross-under piping and to the nozzle at the other end so as to communicate steam through an interior of the inner cylinder;

vent means for communicating steam from the collection chamber to the interior of the inner cylinder, thereby equalizing pressure around the circumference of the entry gap and increasing effectiveness of moisture entrapment; and vane means disposed in at least an upper end portion of the pre-separator body, for directing steam flow into the collection chamber in a swirling direction.

13. A moisture pre-separator as recited in claim 12, wherein the vane means comprises a helical protrusion formed on the outer surface of the inner cylinder on at least an upper portion of the inner cylinder.

14. A moisture pre-separator as recited in claim 12, wherein the vane means comprises a helical protrusion formed on the inner surface of the outer cylinder on at least an upper portion of the outer cylinder.

15. A moisture pre-separator for a steam turbine having an exhaust portion and an exhaust nozzle, the pre-separator comprising:

an inner cylinder having inner and outer surfaces;

an outer cylinder having inner and outer surfaces and being concentric with the inner cylinder;

a bottom interconnecting lower ends of the inner and outer cylinders;

an annular collection chamber formed by the outer surface of the inner cylinder, the inner surface of the outer cylinder, and the bottom;

a drain disposed in the outer cylinder near the bottom for draining moisture collected in the annular collection chamber;

an upper cylinder extension connected to and extending the inner cylinder into the exhaust nozzle of the exhaust portion of the steam turbine, an entry gap being formed between the upper cylinder extension and the exhaust nozzle;

said inner and outer cylinders and bottom forming a pre-separator body which is connectable at one end to cross-under piping and to the nozzle at the other end so as to communicate steam through an interior of the inner cylinder;

vent means for communicating steam from the collection chamber to the interior of the inner cylinder, thereby equalizing pressure around the circumference of the entry gap and increasing effectiveness of moisture entrapment, wherein the vent means comprises a plurality of vent holes formed in the inner cylinder, and a deflector formed at least partially around each vent hole.

16. A method for increasing film entrapment effectiveness of a pre-separator having an inner cylinder, an outer cylinder, a bottom and an annular collection chamber formed by the inner and outer cylinders and the bottom, the method comprising:

forming vent holes in the inner cylinder to equalize pressure around a circumference of an entry gap between an upper cylinder extension which is connected to the inner cylinder and an exhaust nozzle of an exhaust portion of a steam turbine, said entry gap providing an entrance to said collection chamber, and directing steam flow in the collection chamber with the vane means to create a swirling flow within the collection chamber.

* * * * *